US009070315B2

(12) United States Patent
Hong et al.

(10) Patent No.: US 9,070,315 B2
(45) Date of Patent: Jun. 30, 2015

(54) DISPLAY DEVICE

(71) Applicant: LG DISPLAY CO., LTD., Seoul (KR)

(72) Inventors: Moo Kyoung Hong, Changwon-si (KR); Kyoung Don Woo, Paju-si (KR); Eun Jeong Jin, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 114 days.

(21) Appl. No.: 13/713,684

(22) Filed: Dec. 13, 2012

(65) Prior Publication Data

US 2013/0147775 A1 Jun. 13, 2013

(30) Foreign Application Priority Data

Dec. 13, 2011 (KR) ..... 10-2011-0134034

(51) Int. Cl.
*G09G 5/00* (2006.01)

(52) U.S. Cl.
CPC ..... *G09G 5/00* (2013.01)

(58) Field of Classification Search
CPC ..... G09G 2310/0289
See application file for complete search history.

(56) References Cited

U.S. PATENT DOCUMENTS

| | | | | |
|---|---|---|---|---|
| 6,995,742 | B2 * | 2/2006 | Park et al. | 345/100 |
| 7,057,359 | B2 * | 6/2006 | Hung et al. | 315/291 |
| 2008/0012797 | A1 * | 1/2008 | Kil | 345/63 |
| 2008/0129717 | A1 * | 6/2008 | Lee et al. | 345/204 |
| 2008/0211760 | A1 * | 9/2008 | Baek et al. | 345/98 |
| 2009/0033590 | A1 * | 2/2009 | Feng | 345/58 |
| 2009/0058788 | A1 * | 3/2009 | Ha et al. | 345/99 |
| 2009/0284455 | A1 | 11/2009 | Jung | |
| 2011/0193848 | A1 | 8/2011 | Kojima | |
| 2011/0316821 | A1 * | 12/2011 | Suzuki et al. | 345/204 |

FOREIGN PATENT DOCUMENTS

KR 1020060131317 A 12/2006

OTHER PUBLICATIONS

Office Action issued in corresponding Korean Patent Application No. 10-2011-0134034, mailed May 28, 2013, 4 pages.

Office Action issued in Taiwan Patent Application No. 101147216, mailed Jul. 9, 2014, 9 pages.

* cited by examiner

*Primary Examiner* — Kathy Wang-Hurst
*Assistant Examiner* — Peijie Shen
(74) *Attorney, Agent, or Firm* — Brinks Gilson & Lione

(57) ABSTRACT

A display device is disclosed which includes: a control substrate configured to include a timing controller; a data connector configured to transfer signal from the control substrate to a display panel; a data driver mounted to the data connector; at least one outer connector disposed by at least one of both sides of the data connector and loaded with a driver chip, wherein the driver chip and the data driver are loaded on the outer connector and the data connector using the same bonding system, respectively.

8 Claims, 3 Drawing Sheets

DISPLAY DEVICE

The present application claims priority under 35 U.S.C. §119(a) of Korean Patent Application No. 10-2011-0134034 filed on Dec. 13, 2011, which is hereby incorporated by reference in its entirety.

BACKGROUND

1. Field of the Disclosure

The present application relates to a display device.

2. Description of the Related Art

A variety of display devices adapted to display information are being developed. The display devices include liquid crystal display (LCD) devices, plasma display panel (PDP) devices, electrophoresis display devices, organic light-emitting display (OLED) devices and semiconductor light-emitting display devices, as an example.

Among the display devices, the LCD devices or the OLED devices each include a driver portion configured to drive a plurality of sub-pixels arranged in a matrix shape. The driver portion includes a timing controller, a gate driver, a data driver and so on. At least one of the gate driver and the data driver can be formed on a display panel. The timing controller is formed on a printed circuit board connected to the display panel.

In a part of the LCD devices or the OLED devices, the gate driver is formed on the display panel in a GIP (Gate In Panel) system, in order to implement a narrow bezel and simplify circuit configuration. Meanwhile, gate drive signals used to drive the gate driver are generated in a level shifter. However, the level shifter is formed on the printed circuit board, even though the GIP system is applied to the LCD device or the OLED device. As such, signal lines connected between the printed circuit board and the display panel increase. Also, the signal lines must be lengthened, so that signals on the signal lines are largely affected by noise. Moreover, defects can be generated when a FPCB (Flexible Printed Circuit Board) loaded with the signal lines is attached to the display panel.

SUMMARY

A display device includes: a control substrate configured to include a timing controller; a data connector configured to transfer signal from the control substrate to a display panel; a data driver mounted to the data connector; at least one outer connector disposed by at least one of both sides of the data connector and loaded with a driver chip, wherein the driver chip and the data driver are loaded on the outer connector and the data connector using the same bonding system, respectively.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EXEMPLARY EMBODIMENTS

Figure 1:
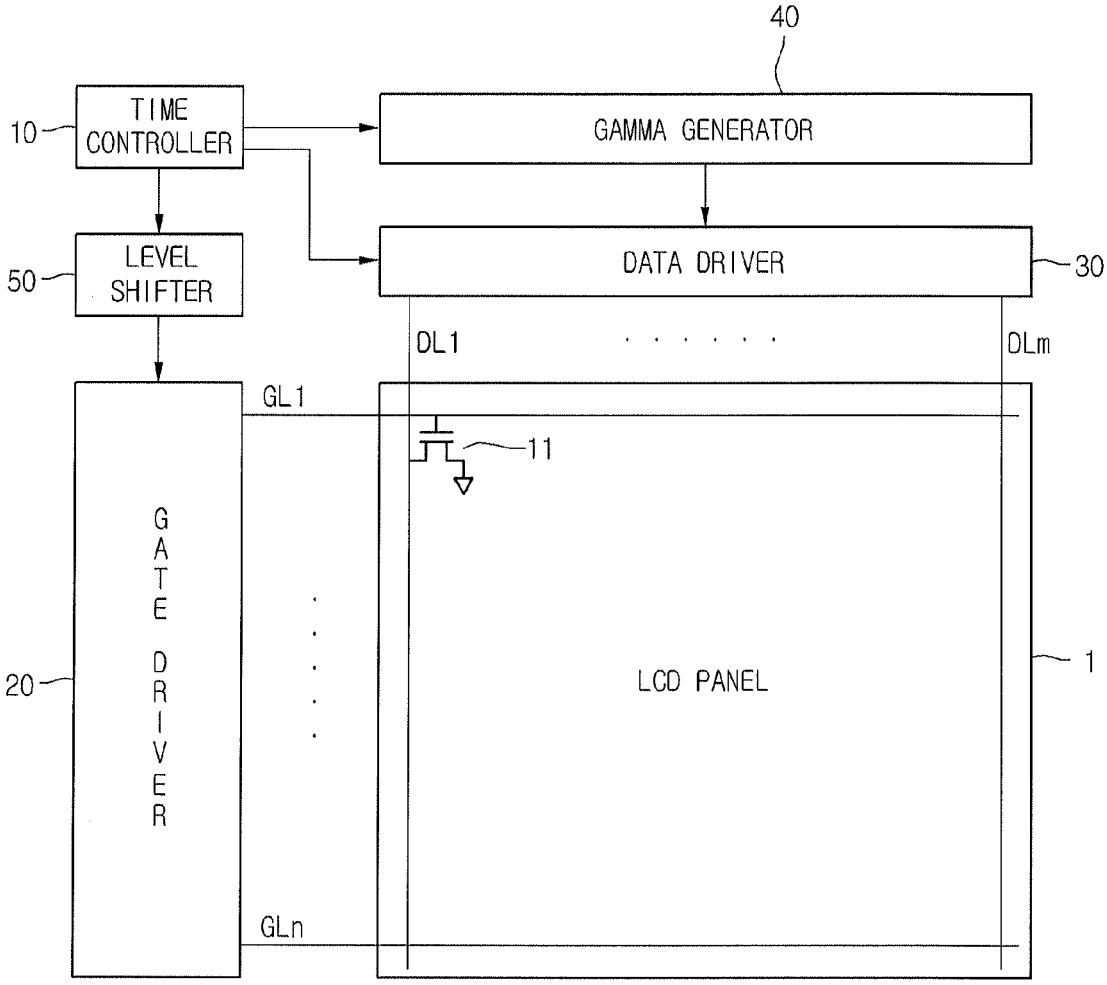
FIG. 1 is a block diagram showing a display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing a display device according to an embodiment of the present disclosure.

Referring to FIG. 1, the display device according to an embodiment of the present disclosure can include a display panel 1, a timing controller 10, a gate driver 20, a data driver 30, a gamma generator 40 and a level shifter 50.

The display panel 1 can include a plurality of gate lines GL1~GLn and a plurality of data lines DL1~DLm. The gate lines GL1~GLn and the data lines DL1~DLm crossing each other can define a plurality of pixel regions. Also, the display panel 1 can further include a thin film transistor 11 in each pixel region. The thin film transistor 11 can be electrically connected to one of the gate lines GL1~GLn and one of the data lines DL1~DLm.

The timing controller 10 can receive a data clock signal Dclk, a vertical synchronous signal Vsync, a horizontal synchronous signal Hsync and so on together with data signals, from an external graphic card. The timing controller 10 can derive timing control signals, which are used to control the gate driver 20 and the data driver 30, from the received data clock signal Dclk, vertical synchronous signal Vsync and horizontal synchronous signal Hsync. The timing control signals can include gate control signals and data control signals.

The gate control signals can include a gate start pulse GSP, a gate shift clock GSC and a gate output enable signal GOE, as an example. The gate start pulse GSP is used to control a driving start time point of the first gate line GL1 of the display panel 1 in every frame. The gate shift clock GSC is used to sequentially control driving start time points of the gate lines GL1~GLn of the display panel 1. The gate output enable signal GOE is used to control time points when the gate signals are applied to the respective gate lines GL1~GLn.

The data control signals can include a source start pulse SSP, a source shift clock SSC, a source output enable signal SOE, a polarity signal POL and so on. The source start pulse SSP is used to control a supply start time point for one line of data signals every horizontal period. The source shift clock SSC is used to sequentially control supply time points of the data signals. The source output enable signal SOE is used to control a supply time point for one line of data voltages which are applied from the data driver to the LCD panel 1. The polarity signal POL is used to select polarities of the data voltages. In other words, the polarity signal POL enables each of the data voltages to selectively have one of a positive level and a negative level.

Moreover, the timing controller 10 can rearrange the data signals applied from the external graphic card in a data format required by the data driver 30.

The level shifter 50 can amplify drive voltages, which will be applied to the gate driver 20, using a power voltage applied from a power supplier (not shown). The level shifter 50 can derive gate drive signals from the gate control signals, which are applied from the timing controller 10, and the power voltage, which is applied from the power supplier. The gate drive signals are applied from the level shifter 50 to the gate driver 20. The gate drive signals can include the gate start pulse GSP, the gate shift clock GSC and the gate output enable signal GOE.

The gamma generator 40 can generate gamma voltages from the power voltage, which is applied from the power supplier (not shown). The power supplier can be included in the timing controller 10. The gamma generator 40 derives a plurality of gamma voltages, which correspond to gray levels of the image data, using the power voltage. The plurality of gamma voltages is applied from the gamma generator 40 to the data driver 30. To this end, the gamma generator 40 can include a gamma reference voltage generator and a gamma voltage generator, which are not shown in the drawing. The gamma reference voltage generator derives gamma reference voltages from the power voltage. The gamma voltage generator derives the plurality of gamma voltages from the gamma reference voltages, which are applied from the gamma reference voltage generator.

The gamma generator 40 can include a serial circuit of resistors. The gamma generator 40 can generate the plurality of gamma voltages by voltage-dividing the power voltage and apply the plurality of gamma voltages to the data driver 30.

The gamma generator 40 can generate the gamma voltages using an integrated circuit IC. The gamma reference voltage generator (not shown) can generate the gamma reference voltages using an integrated circuit. For example, the gamma reference generator can be designed using a programmable gamma integrated-circuit. The programmable gamma integrated-circuit is configured to generate and output the gamma reference voltages. In detail, the programmable gamma integrated-circuit can adjust the gamma reference voltages by amending only a program. As such, the programmable gamma integrated-circuit can compensate for a variation of the gamma voltage in accordance with the deviation between the display devices.

The gate driver 20 can be formed on the display panel in a GIP (gate-in-panel) system. The gate driver 20 can generate gate signals, which are sequentially enabled in a single horizontal interval, using the gate drive signals applied from the level shifter 50. To this end, the gate driver 20 sequentially shifts the gate start pulse GSP and allows the shifted signals to have a swing width between the gate drive voltages which are adapted to drive the thin film transistors 11 within the pixel regions of the display panel 1. Such a gate driver 20 can include a shift register configured to shift the gate start pulse GSP and a level shift array for level-shifting the signals from the shift register. The gate signals can be applied from the gate driver 20 to the pixel regions of the display panel 1 through the gate lines GL1~GLn.

The data driver 30 replies to the data control signals from the timing controller 10 converts the data signals serially applied from the timing controller 10 into the data signals with parallel arrangement. To this end, the data driver samples and latches the data signals applied from the timing controller 10. Also, the data driver 30 converts the data signals corresponding digital signals into data voltages corresponding to analog signals using the gamma voltages. The converted data voltages are applied from the data driver 30 to the pixel regions of the display panel 1 through the data lines DL1~DLm.

The thin film transistor 11 is turned-on/off by the gate signal. As such, the thin film transistor 11 can transfer the data voltage on the data line DL to a pixel. In accordance therewith, an image can be displayed on the display panel 1.

Figure 2:
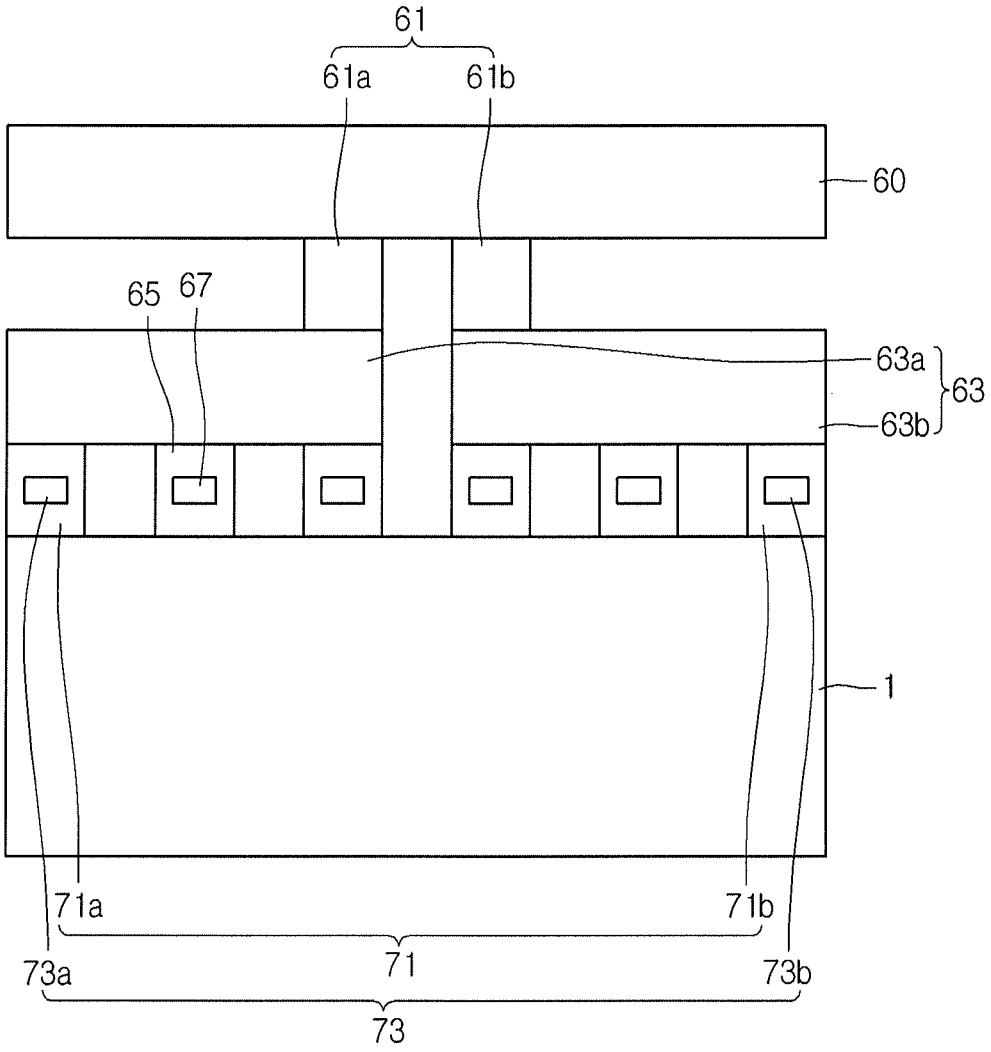
FIG. 2 is a planar view showing a display device according to a first embodiment of the present disclosure.

FIG. 2 is a planar view showing a display device according to a first embodiment of the present disclosure.

Referring to FIG. 2, the display device according to a first embodiment of the present disclosure can include a display panel 1, a control substrate 60 and a source substrate 63.

The control substrate 60 can be loaded with the timing controller 10 and the gamma generator 40. The control substrate 60 can be electrically connected to the source substrate 63 through a plurality of primary connectors 61. For example, the plurality of primary connectors 61 connected between the control substrate 60 and the source substrate 63 can include a first primary connector 61*a* and a second primary connector 61*b*. Each of the primary connectors 61 can be a flexible flat cable FFC or a flexible printed circuit film FPCF.

The source substrate 63 can be electrically connected to the control substrate 60 by means of the plurality of primary connectors 61. The source substrate 63 can include a first source substrate 63*a* and a second source substrate 63*b*. The first source substrate 63*a* can be electrically connected to the control substrate 60 through the first primary connector 61*a*. The second source substrate 63*b* can be electrically connected to the control substrate 60 through the second primary connector 61*b*.

The source substrate 63 can be electrically connected to the display panel 1 through a plurality of data connectors 65. Also, outer connectors 71 can be arranged between the source substrate 63 and the display panel 1. The outer connectors 71 can connect electrically the source substrate 63 with the display panel 1. Each of the data connectors 63 can be loaded with a data driver integrated-circuit (IC) chip 67. Similarly, each of the outer connectors 71 can be loaded with a driver chip 73. The driver chip 73 can be mounted on the outer connector 71 in a COF (Chip on Flexible printed film) system. Alternatively, the driver chip 73 can be mounted on the outer connector 71 in one of a TCP (Tape Carrier Package) system and a COG (Chip On Glass) system. The data driver IC chip 67 can be mounted on the data connector 65 in the same bonding system as the driver chip 73. In other words, the data driver IC chip 67 can be mounted on the data connector 71 in one of the COF, TCP and COG systems. Since the driver chip 73 and the data driver IC chip 67 are mounted on the outer connector 71 and the data connector 65 in the same bonding system, respectively, any thickness difference is not generated between the outer connector 71 and the data connectors 65. As such, the generation of defects in a modular process can be prevented.

The plurality of primary connectors 61 can transfer signals generated in the timing controller 10, which is formed on the control substrate 60, to the source substrate 61. The signals transferred to the source substrate 63 can be applied to the display panel 1 through lines on the source substrate 63 and the data driver IC chips 67 of the data connectors 65.

The driver chip 73 can be the same as that on the control substrate of the related display device. Also, the driver chip 73 can include a level shifter.

If the driver chip 73 includes the level shifter, gate drive signals can be directly applied from the level shifter to the gate driver on the display panel 1. The display device of the first embodiment can largely reduce noise for the gate drive signal, compared to that of the related art allowing the gate drive signals to be applied from the control substrate to the display panel. In other words, the display device of the first embodiment can prevent the distortion of the gate drive signal. Also, the size of the control substrate 60 can be reduced because lines arranged between the control substrate 60 and the source substrate 63 used to transferring the gate drive signals can be removed. Moreover, since lines arranged on the source substrate 63 and used to transfer the gate drive signals are removed, the size of the source substrate 63 can also be reduced. In accordance therewith, the display device of the first embodiment can be lighter weight and slimness.

The outer connectors 71 can include a first outer connector 71*a* and a second outer connector 71*b*. The outer connectors 71 can be disposed by both sides of the plural data connectors 65. The first outer connector 71*a* can be loaded with a first driver chip 73*a*, and the second outer connector 71*b* can also be loaded with a second driver chip 73*b*. Since the outer connectors 71 each loaded with the driver chip 73, which includes the level shifter are disposed by both sides of the plural data connectors 65, the gate drive signals are directly applied from the level shifters to the gate driver on the display panel 1. Also, the display panel 1 can be driven in a dual gate mode because the two level shifters are mounted on both the outer connectors 71 which are arranged by both sides of the plural data connectors 65.

The driver chip 73 can include the gamma generator. The driver chip 73 is fabricated to include an integrated circuit. As such, the driver chip 73 can include a programmable gamma IC. In other words, the driver chip 73 on the outer connector 71 includes the programmable gamma IC. As such, the circuit configuration of the control substrate 60 can be simplified, and furthermore the size of the control substrate 60 can be reduced. Also, signals being transferred through the primary connectors 61 decrease, thereby reducing the number of primary connectors 61. Moreover, the size of the source substrate 63 can be reduced because signals being transferred through the source substrate 63. Therefore, the display device of the first embodiment can be lighter weight and slimness.

Figure 3:
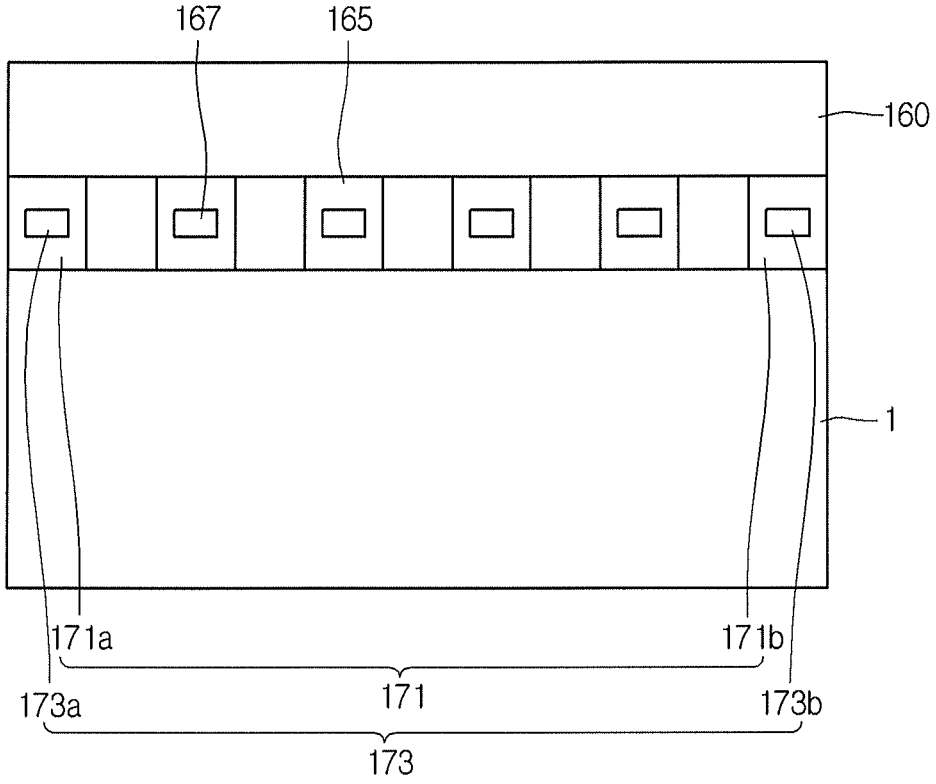
FIG. 3 is a planar view showing a display device according to a second embodiment of the present disclosure.

FIG. 3 is a planar view showing a display device according to a second embodiment of the present disclosure.

The display device of the second embodiment has the same configuration as that of the first embodiment described above, except that the control substrate is connected to the display panel using the data connectors. Accordingly, the description of the first embodiment to be repeated in the second embodiment of the present disclosure will be omitted. Also, the display device according a second embodiment of the present disclosure will refer to the same reference numbers for the same elements as that according to the first embodiment.

Referring to FIG. 3, the display device according to a second embodiment of the present disclosure can include a display panel 1 and a control substrate 160.

The control substrate 160 can be electrically connected to the display panel 1 through a plurality of data connectors 165 and outer connectors 171 disposed by both sides of the plural data connectors 165. Each of the data connectors 165 can be loaded with a data driver IC chip 167. Each of the outer connector 171 can be loaded with a driver chip 173. The driver chip 173 can be mounted on the outer connector 171 in one of COF, TCP and COG systems. The data driver IC chip 167 can also be mounted on the data connector 165 in the same bonding system as the driver chip 173. Since the driver chip 173 and the data driver IC chip 167 are mounted on the outer connector 71 and the data connector 65 in the same bonding system, respectively, any thickness difference is not generated between the outer connector 171 and the data connectors 165. As such, the generation of defects in a modular process can be prevented.

The driver chip 173 can include a level shifter. In other words, the driver chip 173 on the outer connector 171 can include the level shifter. As such, gate drive signals can be directly applied from the level shifter to the gate driver on the display panel 1. In accordance therewith, the display device of the second embodiment can largely reduce noise for the gate drive signal. That is, the display device can prevent the distortion of the gate drive signal. Also, the display device of the second embodiment can be lighter weight and slimness because the size of the control substrate 160 is reduced.

The outer connectors 171 can include a first outer connector 171*a* and a second outer connector 171*b*. The outer connectors 171 can be disposed by both sides of the plural data connectors 165. The first outer connector 171*a* can be loaded with a first driver chip 173*a*, and the second outer connector 171*b* can also be loaded with a second driver chip 173*b*. Since the outer connectors 171 each loaded with the driver chip 173 which includes the level shifter are disposed by both sides of the plural data connectors 165, the gate drive signals can be directly applied from the level shifters to the gate driver on the display panel 1. Also, the display panel 1 can be driven in a dual gate mode because the two level shifters are mounted on both the outer connectors 171 which are arranged by both sides of the plural data connectors 165.

Alternatively, the driver chip 173 can include the gamma generator. The driver chip 173 is fabricated to include an integrated circuit. As such, the driver chip 173 can include a programmable gamma IC. In other words, the driver chip 173 on the outer connector 171 includes the programmable gamma IC. As such, the circuit configuration of the control substrate 160 can be simplified, and furthermore the size of the control substrate 160 can be reduced. Therefore, the display device of the second embodiment can be lighter weight and slimness.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a control substrate configured to include a timing controller;

a data connector configured to transfer signal from the control substrate to a display panel;

a data driver mounted to the data connector;

at least one outer connector disposed by at least one of both sides of the data connector and loaded with a driver chip, the driver chip comprising at least one of a level shifter and a gamma generator, wherein the driver chip derives gate drive signals from gate control signals applied from the timing controller, and the gate drive signals are applied to gate drivers mounted on the display panel in a GIP (gate in panel) system, wherein the data driver is mounted only on the data connector and the driver chip is mounted only on the at least one outer connector, wherein the data driver and the driver chip are mounted on separate connectors, and wherein the driver chip and the data driver are loaded in one of COF (chip on flexible printed circuit film) system, TCP (tape carrier package), and COG (chip on glass) systems.

2. The display device of claim 1, wherein the driver chip includes a programmable gamma IC (integrated circuit).

3. The display device of claim 1, further comprising:

a source substrate connected to the data connector and the outer connector; and an auxiliary connector configured to connect the source substrate with the control substrate.

4. The display device of claim 1, wherein the at least one outer connector includes first and second outer connectors which are disposed in both sides of the data connector.

5. The display device of claim 4, wherein the gate drivers which are disposed in both sides of a display area for displaying an image and each configured to receive the gate drive signals from the respective level shifters.

6. A display device comprising:

a control substrate configured to include a timing controller;

a plurality of data connectors configured to transfer signal from the control substrate to a display panel;

a plurality of data drivers mounted on the plurality of data connectors;

a pair of outer connectors disposed by both sides of the plurality of data connectors, the pair of outer connectors each being loaded with a driver chip, the driver chip comprising at least one of a level shifter and a gamma generator, wherein the driver chips derive gate drive signals from gate control signals applied from the timing controller, and the gate drive signals are applied to gate drivers mounted on the display panel in a GIP (gate in panel) system, wherein the data drivers are mounted only on the data connectors and the driver chips are mounted only on the pair of outer connectors, and wherein the driver chip and the data driver are loaded in one of COF (chip on flexible printed circuit film) system, TCP (tape carrier package), and COG (chip on glass) systems.

7. The display device of claim 6, wherein the data drivers and the driver chips are mounted on separate connectors in the same bonding system.

8. The display device of claim 6, wherein the plurality of data connectors and the plurality of outer connectors are mounted along the same edge of the display panel.

* * * * *